United States Patent [19]

Szymber

[11] 4,022,044

[45] May 10, 1977

[54] MACHINES FOR CENTERLESS COLD ROLLING OF GEARS

[75] Inventor: Oleg Szymber, Palos Verdes, Calif.

[73] Assignee: Southwestern Industries, Inc., Los Angeles, Calif.

[22] Filed: June 18, 1976

[21] Appl. No.: 697,382

[52] U.S. Cl. ..... 72/108; 72/73; 72/703

[51] Int. Cl.[2] ..... B21H 5/02

[58] Field of Search ..... 72/74, 107, 108, 109, 72/703, 73; 29/159.2; 10/152 R

[56] References Cited

UNITED STATES PATENTS

| | | | |
|---|---|---|---|
| 2,342,917 | 2/1944 | Brown | 72/108 |
| 3,533,258 | 10/1970 | Leonard, Jr. et al. | 72/108 |

*Primary Examiner*—Lowell A. Larson
*Attorney, Agent, or Firm*—Christie, Parker & Hale

[57] ABSTRACT

A centerless gear forming tool for cold rolling teeth on a gear blank in which the blank is inserted between a pair of gear forming rolls which are movable toward and away from each other. The rolls are urged toward each other by a spring, clamping the blank between them and are caused to rotate synchronously in the same direction. The gear rollers have lugs forming opposing surfaces which engage the blank when the gear rolls are rotated to an initial position. A latch initially holds the rolls apart so that the blank can be inserted between the rolls and clamped in position by rotating the opposing lugs into engagement with the blank. The latch is then released causing the blank to be also clamped between the rolls. Subsequent rotation of the rolls in the direction to move the lugs away from the blank operates to cold form the teeth in the blank under the pressure of the spring.

10 Claims, 5 Drawing Figures

10
12
14
16
18
24
26
30
32
34
36
38
40
42
44
46
66
68
70
72
74

MACHINES FOR CENTERLESS COLD ROLLING OF GEARS

FIELD OF THE INVENTION

This invention relates to forming of gears, and more particularly, to the cold rolling of finished gear teeth in a gear blank.

BACKGROUND OF THE INVENTION

In U.S. Pat. No. 3,877,273 assigned to the same assignee as the present invention, there is described an arrangement for cold rolling finished gear teeth on the smooth periphery of a metal gear blank. The periphery of the gear blank is forcefully engaged by the circumference of a pair of gear-forming rolls. The rolls have teeth which are the conjugate in profile to the teeth to be formed. If the blank is rolled between the opposing gear-forming rollers under pressure which squeezes the blank between the rollers, the rolling action produces an inelastic deformation of the blank material into desired gear profile.

To achieve satisfactory results, the gear blank must be very accurately positioned between the rollers before the rollers are brought into contact with the gear blank. The axis of the blank must be held exactly parallel to the axis of rotation of the two rolls. However, once the blank is clamped between the gear rolls, the holder must no longer impose any restraints on the movement of the blank as it is rolled between the forming rolls. In addition, the rolls must be accurately indexed in relation to each other. Only if the blank is properly positioned relative to the forming roll at the time the workpiece is first engaged by the rolls and if the rolls are properly indexed with respect to each other will the trace of teeth impressions on the blank defined by one of the rolls register exactly with the trace defined by the forming teeth of the other roll. In addition the force of engagement of the forming rolls with the workpiece must be increased gradually from a very light pressure to the required cold forming of the finished gear teeth.

SUMMARY OF THE INVENTION

The present invention is directed to a cold forming gear rolling device, and is particularly directed to an improved arrangement for initially positioning the workpiece between the rolls and for ensuring proper indexing between the rolls and the workpiece. This is achieved, in brief, by providing gear-forming apparatus in which a pair of gear-forming rolls are rotatably supported with their axis of rotation parallel and with one roll being movable radially toward or away from the other roll. A spring normally urges the rolls toward each other but a latch mechanism initially holds the rolls separated sufficiently for a gear blank to be inserted between the rolls. The rolls have lugs projecting from the outer circumference, the lugs having opposing surfaces which are moved toward each other by rotation of the gear rolls in one direction, so that the blank can be clamped betwen the lugs by rotating the rolls to an initial position. After the opposing surfaces of the lugs clamp the blank, the latch is released, permitting the rolls to move into contact with the periphery of the blank. Rotation of the rolls moves the lugs out of clamping relation with the blank and rolls the blank between the forming teeth of the rolls.

DESCRIPTION OF THE DRAWINGS

For a better understanding of the invention, reference should be made to the accompanying drawings wherein:

FIG. 4 is a partial sectional view taken on the line 4—4 of FIG. 3; and

DETAILED DESCRIPTION

Figure 1:
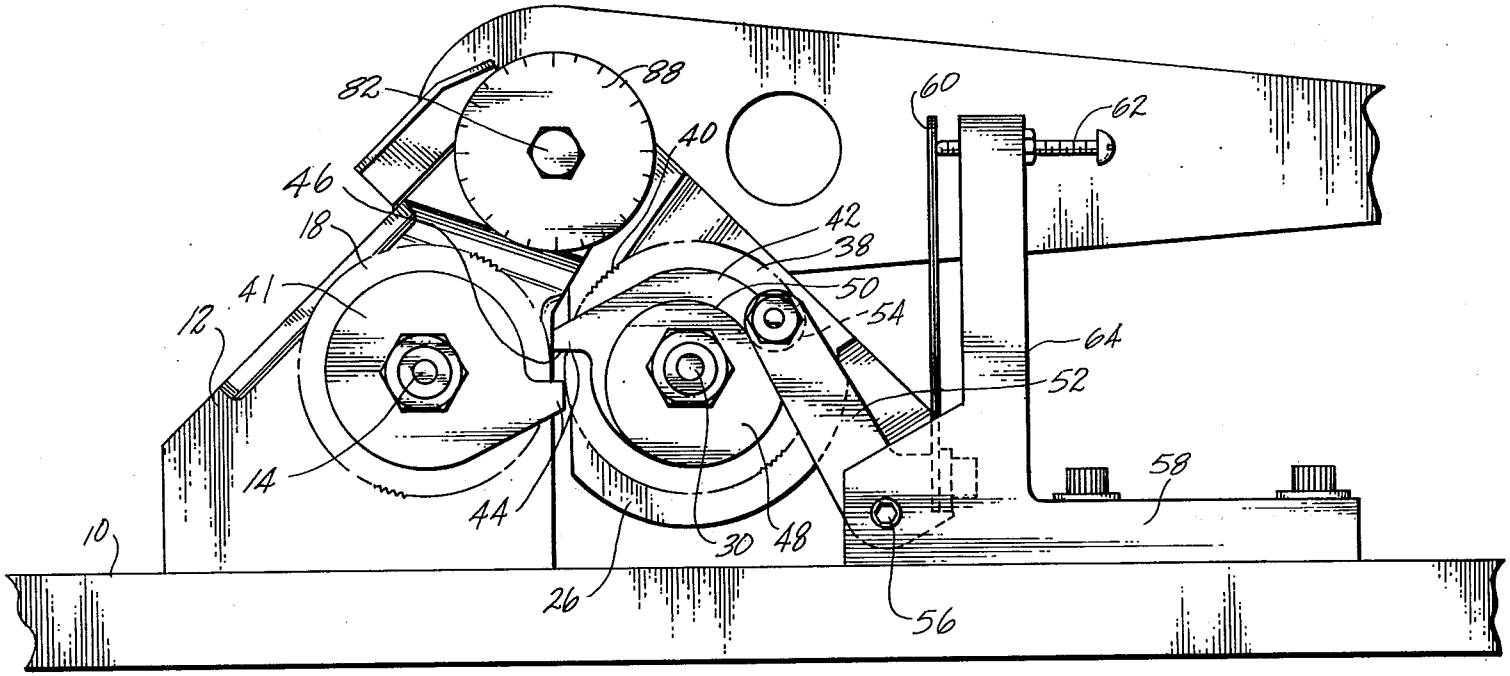
FIG. 1 is an elevational view of one side of the preferred embodiment.
Figures 1, 2:
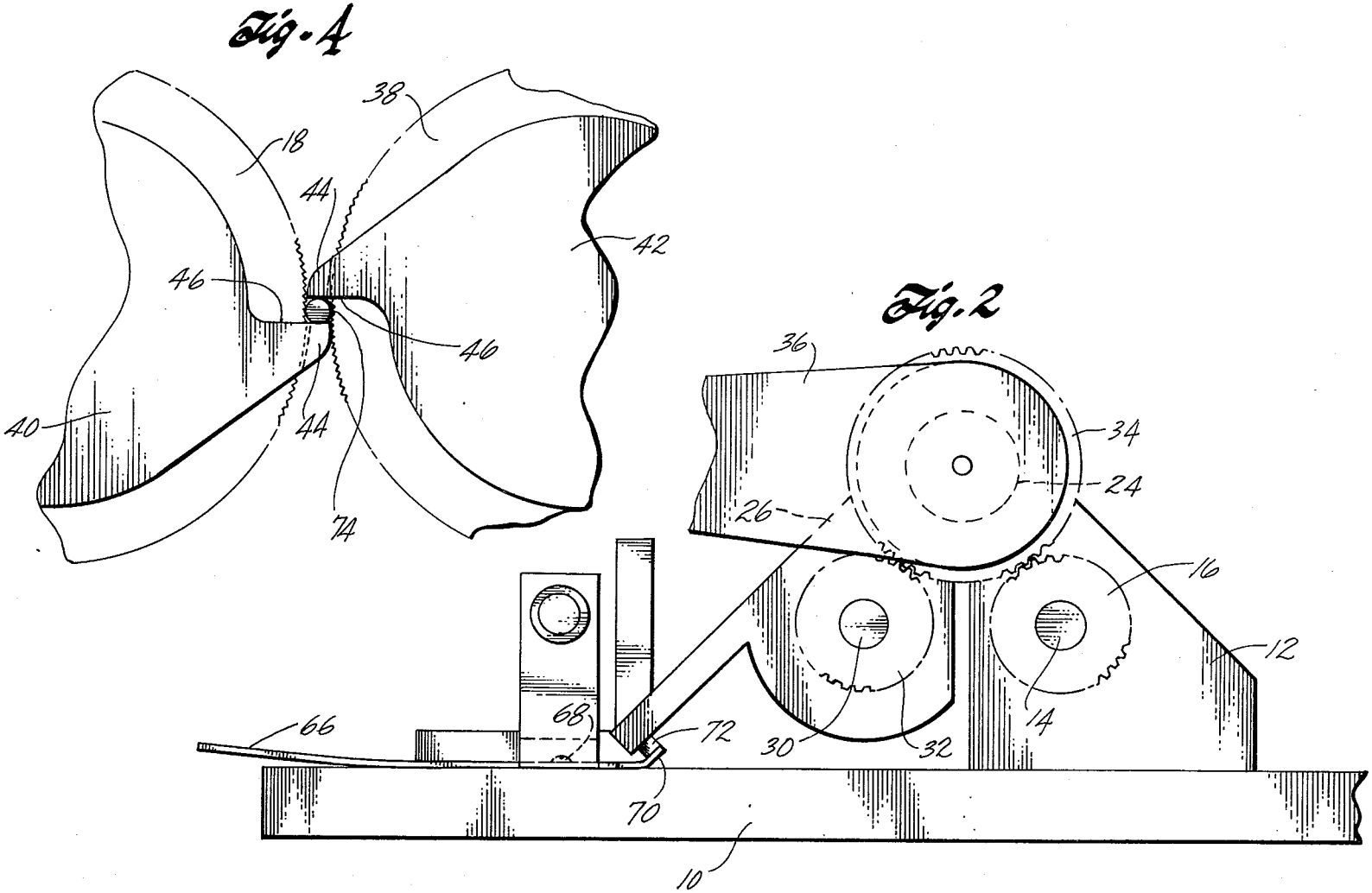
FIG. 2 is an elevational view of the opposite side of the embodiment of FIG. 1.
Figure 3:
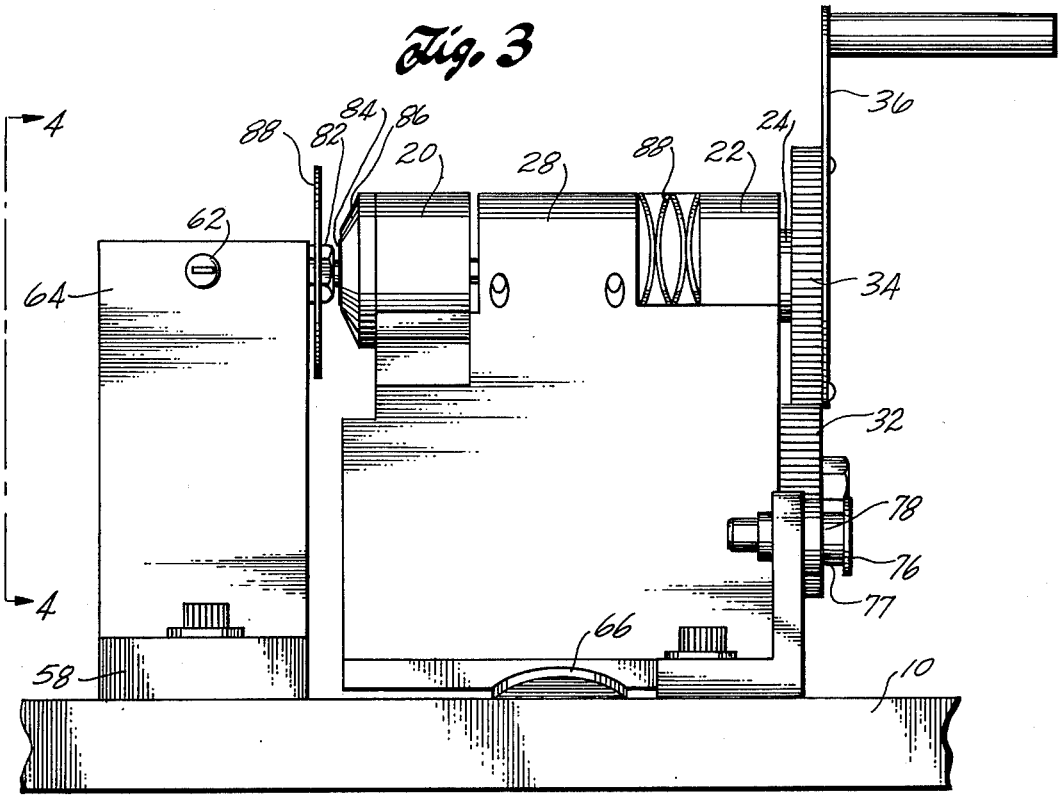
FIG. 3 is an end view of the preferred embodiment.
Figure 5:
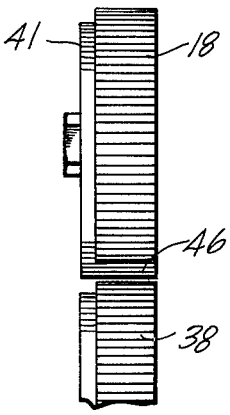
FIG. 5 is a detailed view of the gear rollers.

Referring to the drawings in detail, the numeral 10 indicates generally a base plate for the centerless gear roll forming machine of the present invention. A frame block 12 is bolted on the top surface of the base plate 10. Journaled in the block 12 is a shaft 14 which extends outwardly from the block on either side. A gear 16 is secured to one end of the shaft while the other end of the shaft terminates in a gear-forming roller 18. The upper corner of the block 12 is bifurcated to provide a pair of spaced arms 20 and 22 which serve as bearing supports and in which are journaled a hinge shaft 24. A carriage 26 has a hinge portion 28 which is secured to the hinge shaft 24 between the arms 20 and 22, the carriage being rotatable with the shaft 24 as well as being movable axially with the shaft between the arms 20 and 22.

A shaft 30 is rotatably supported by the carriage 26, the shafts 14, 24 and 30 all having their axes extending parallel to each other with the spacing between the axes of the shafts 14 and 24 being equal to the spacing between the axes of the shafts 24 and 30. A gear 32 is secured to the end of the shaft 30 and is identical in pitch diameter to the gear 16. A drive gear 34 is journaled on the hinge shaft 24 on the end of the shaft projecting beyond the supporting arm 22. The drive gear 34 is in meshing engagement with both gears 16 and 32. A crank handle 36 is attached to the drive gear 34, the crank handle providing a means of manually rotating the gears 16 and 32 and associated shafts 14 and 30 synchronously in the same direction of rotation.

A second gear-forming roller 38 is connected to the other end of the shaft 30 adjacent the roller 18. Rotation of the carriage 26 about an axis in the shaft 24 controls the spacing between the opposed peripheral surfaces of the gear-forming rollers 18 and 38. The periphery of both roller 18 and 38 have a plurality of forming teeth 40 arranged around the outer periphery which are profiled conjugate to the teeth desired to be formed in the gear blank by the cold roll forming process.

Blank positioning washers 41 and 42 are mounted adjacent the rollers 18 and 38 on the ends of the shafts 14 and 30. Each of the washers include a lug portion 44 which extends radially outwardly from the washer and extends at right angles across the face of the gear-forming teeth of the roller. One edge of the lug portion forms a flat surface 46 extending radially from the periphery of the associated roller. The radial extent of the surface 46 is made greater than the radius of the gear blank but less than the diameter of the gear blank.

In addition to the positioning washer 42, a cam member 48 is secured to the end of the shaft 30. The cam member 48 has an outer cam surface 50 in the form of a spiral which increases in radius in a counterclockwise direction, as viewed in FIG. 1. A cam follower including a follower arm 52 and a cam roller 54 at one end is in rolling engagement with the cam surface 50. The arm 52 is pivotally supported on the base plate 10 by a bracket 58 and a hinge pin 56. A leaf spring 60 is secured at one end to the arm 52. The other end of the leaf spring 60 engages an adjustable stop 62 supported from the base 10 by a bracket 64. Stop 62 is positioned such that the flat spring 60 is deflected by pivoting movement of the arm 52. The spring 60 thereby urges the cam follower 54 against the cam surface 50 of the cam 48 with increasing force as the cam rotates in a clockwise direction, as viewed in FIG. 1. This in turn urges the roller 38 and carriage 26 toward the roller 18 with increasing force.

A latch mechanism is provided for holding the carriage 26 in a loading position in which the rollers 18 and 38 are spaced apart slightly more than the diameter of the gears blank so that the gear blank can be inserted between the gear forming rollers. The latch mechanism includes a release lever 66 pivotally secured to the base plate 10 by a pin 68. The inner end of the lever 66, as indicated at 70, bends upwardly in a direction substantially parallel to the undersurface of the carriage 26 where it can be moved into and out of engagement with a lug 72. When in the latched position, the end 70 engages the lug thereby holding the carriage 26 outwardly against the urging of the spring 60. Rotation of the latch lever 66 moves the end 70 out of engagement with the lugs 72, permitting the carriage to rotate under the urging of the spring 60 in a direction to move the roller 38 towards the roller 18.

In operation the lever 66 is initially engaged with the lug 72 so as to hold the rollers 18 and 38 apart sufficiently for the gear blank to be inserted in the space between the rollers. The rollers are rotated by the crank in a counter-clockwise direction, as viewed in FIG. 1, until the surfaces 46 of the lugs 44 move into clamping position above and below the blank, as shown in detail in FIG. 4. The blank is indicated at 74 in FIG. 4. In clamping the blank 74, the surfaces 46 hold the blank securely in position with the axis aligned in the plane defined by the axes of the gear forming rollers.

With the blank thus clamped between the surfaces 46 of the lugs 44, the latch lever 66 is moved to release the carriage allowing the spring 60 to move the roller 38 toward the roller 18 so that the blank 74 is held firmly between the rollers. In this initial position, the cam roller 54 is positioned at the point of minimum radius of the cam surface 50. As a result, the spring 60 is under minimum deflection and therefore the engaging pressure of the roller with the blank 74 is at a minimum level of pressure. The crank handle 36 is then rotated in a direction to move the rollers in a clockwise rotation, as viewed in FIG. 1, the blank 74 being rolled between the rollers. As the associated cam 48 rotates also in a clockwise direction, the cam roller 54 is urged radially outwardly by the cam surface 50 thereby increasing the deflection of the spring 60 and increasing the pressure exerted by the rollers against the surface of the blank 74. By oscillating the crank handle back and forth, the blank is subjected to the action of the forming teeth, thereby deforming the surface of the blank into the desired gear shape by cold working of the metal.

One of the advantages of the invention is that the engagement of the lugs with the gear blank serves to accurately index the angular position of the two gear forming rollers, thus insuring that the trace of forming teeth impressions on the blank by one of the forming rollers registers exactly with the trace defined on the gear blank by the forming teeth of the other roller. No anti-backlash gears, for example, are required to insure that the rollers are correctly indexed. Furthermore, the cam action insures that the force of engagement of the rollers with the gear blank increases gradually during the initial forming operation. This is also important in achieving accurate tracing of the teeth impressions by the two rollers, as described in detail in the above-identified patent.

One feature of the present invention is a special calibration arrangement for use in rolling bevel gears. The carriage 26 and shaft 24 are movable axially relative to the block 12. To this end the space between the arms 20 and 22 is wider than the hinge portions 28 of the carriage. Spring washers 80 are provided on the shaft 24 between the arm 22 and the carriage to urge the carriage 26 and shaft 24 toward the arm 20. The end of the shaft 24 engages an adjustablle stop in the form of a threaded screw 82 engaging the nut 84 supported from the block 12 by a suitable bracket 86. The screw has a calibrated dial 88. By adjusting the screw, the position of the carriage 26 can be shifted axially against the urging of the spring washers 80. Shifting the carriage 26 also shifts the roller 38 in an axial direction relative to the roller 18. Because the gear teeth are beveled, the axial shift produces an effective angular shift between the beveled teeth of the two rollers. Thus the calibrated screw 82 provides a way of adjusting for exact angular registration between the teeth of the two rollers and the blank.

What is claimed is:

1. A centerless gear forming tool for cold rolling teeth on a gear blank, comprising a frame, a first rotating member including a gear forming roll journaled on the frame for rotation about an axis, a carriage movable with respect to the frame in a direction transverse to the axis of the first rotating member, a second rotating member including a gear forming roll journaled on the carriage opposite the other roll for rotation about an axis parallel to the axis of the first member, drive means for rotating the first and second members in the same direction relative to each other at synchronized angular rates, lug means projecting from the periphery of both of the rolls and movable with the rolls, the lug means having work clamping surfaces extending radially outwardly from the respective rolls, the surfaces moving into opposing relation wih the rotation of the rolls by said drive means in a first direction, and spring means urging the carriage in a direction to move rolls toward each other.

2. Apparatus of claim 1 wherein said spring means includes means for decreasing the force urging the carriage as the rolls are rotated in said first direction and increasing the force as the rolls are rotated in the opposite direction.

3. Apparatus of claim 1 further including a latch means mounted on the frame and releasably engaging the carriage for latching the carriage against the urging of the spring means with the rolls separated by a gap slightly larger than the diameter of the gear blank, the latch when released permitting the carriage under urging of the spring means to move the rolls into clamping engagement with the gear blank.

4. Apparatus of claim 1 wherein the work clamping surfaces of the lugs project beyond the periphery of the respective rolls by an amount slightly in excess of the radius of the gear blank but less than the diameter of the gear blank, the gear blank being clamped between the clamping surface of the lugs by rotation of the rolls to a position where the lugs engage diametrically opposite sides of the gear blank.

5. Apparatus of claim 4 wherein the lug means includes a pair of dog wheels mounted on the first and second rotatable members adjacent the rolls, the dog wheels being of smaller diameter than the rolls and each having a lug portion projecting radially outwardly and axially across the outer perimeter of the respective rolls.

6. Apparatus of claim 5 wherein the dog wheels and lugs are adjustable angularly relative to the associated gear rolls.

7. Apparatus of claim 2 wherein the spring means includes a cam having a spiral surface mounted rotatably with the roll journaled on the carriage, a cam follower engaging the cam surface, and a spring urging the follower against the surface substantially along a line intersecting both the axis of rotation of the rolls.

8. Apparatus of claim 1 further including means for shifting one roll axially relative to the other roll.

9. A gear forming tool comprising a first rotatably supported roll having gear forming teeth around the perimeter, a second rotatably supported roll having teeth around the perimeter, means urging the perimeters of the two rolls toward each other to clamp a gear block between the rolls, means for simultaneously rotating the two rolls in the same direction at the same peripheral velocity, the lug means associated with both rolls extending radially beyond the periphery of the rolls, the lug means having radial surfaces rotated with the rolls in opposing relationship along a line intersecting the two axes of revolution of the rolls for clamping the gear block between the surfaces.

10. Apparatus of claim 9 further including means for increasing the force urging the rolls toward each other as the rolls and associated lug means are rotated in a direction to separate the clamping surface of the lug means.

* * * * *